US011965344B2

(12) United States Patent
Ubiñana Félix

(10) Patent No.: US 11,965,344 B2
(45) Date of Patent: Apr. 23, 2024

(54) ANCHORING HEAD FOR FORMWORK STRUTS AND FORMWORK STRUT FOR PRODUCING SLOPED FLOORS

(71) Applicant: SISTEMAS TÉCNICOS DE ENCOFRADOS, S.A., Parets del Valles (ES)

(72) Inventor: José Luis Ubiñana Félix, Parets del Valles (ES)

(73) Assignee: SISTEMAS TÉCNICOS DE ENCOFRADOS, S.A., Parets del Valles (ES)

( * ) Notice: Subject to any disclaimer, the term of this patent is extended or adjusted under 35 U.S.C. 154(b) by 41 days.

(21) Appl. No.: 17/909,644

(22) PCT Filed: Jan. 21, 2021

(86) PCT No.: PCT/ES2021/070035
§ 371 (c)(1),
(2) Date: Sep. 6, 2022

(87) PCT Pub. No.: WO2021/176117
PCT Pub. Date: Sep. 10, 2021

(65) Prior Publication Data

US 2023/0108455 A1 Apr. 6, 2023

(30) Foreign Application Priority Data

Mar. 6, 2020 (EP) ..... 20382161

(51) Int. Cl.
*E04G 11/48* (2006.01)
*E04G 11/50* (2006.01)

(52) U.S. Cl.
CPC ..... *E04G 11/483* (2013.01); *E04G 11/50* (2013.01)

(58) Field of Classification Search
CPC ..... E04G 11/483; E04G 11/486; E04G 11/48; E04G 11/38; E04G 11/50; E04G 11/36; E04G 2025/006
See application file for complete search history.

(56) References Cited

U.S. PATENT DOCUMENTS 4,884,791 A * 12/1989 Callender ..... E04G 17/02 269/88
7,971,395 B1 * 7/2011 Vigil ..... E04G 11/48 52/9

(Continued)

FOREIGN PATENT DOCUMENTS

CA 2994076 A1 8/2019
CA 3030905 A1 * 7/2020 ..... E04G 11/36

(Continued)

OTHER PUBLICATIONS

International Search Report for related patent application PCT/ES2021/070035 prepared by the European Patent Office and dated Apr. 21, 2021, in English.

(Continued)

*Primary Examiner* — Jonathan Liu
(74) *Attorney, Agent, or Firm* — Hassan Abbas Shakir; Shakir Law PLLC

(57) ABSTRACT

An anchoring head for formwork struts is intended for the implementation of inclined floor slabs, and includes a support, an erect region coupled to a strut to be mounted, wherein there are two separate positioning shafts transversely arranged with respect to the erect region, that are adjustable in height by means of a height adjusting system, the positioning shafts being configured to support a respective beam in a fixed way by means of releasable locking means. The support includes a visual indicating means for indicating the angular position of each beam to be supported, the indicating means being associated with the positioning (Continued)

shaft of the beam to be supported by means of a cam arrangement, the cam arrangement being provided with a cam member coupled to the positioning shaft, such that the position of the cam member is directly related to the height at which the positioning shaft is located.

17 Claims, 9 Drawing Sheets

(56) References Cited

U.S. PATENT DOCUMENTS

| | | | | |
|---|---|---|---|---|
| 8,066,247 | B2 | 11/2011 | Spera | |
| 8,262,056 | B2 * | 9/2012 | Schwoerer | E04G 11/483 249/210 |
| 2007/0102603 | A1 * | 5/2007 | Newell | F16M 11/10 248/219.2 |
| 2012/0193591 | A1 * | 8/2012 | Huang | B66F 1/06 254/100 |
| 2019/0003193 | A1 * | 1/2019 | Whittemore | E04G 21/30 |
| 2019/0071885 | A1 * | 3/2019 | Faresin | E04G 11/486 |
| 2021/0381263 | A1 * | 12/2021 | Charitou | E04G 11/483 |

FOREIGN PATENT DOCUMENTS

| | | | | | |
|---|---|---|---|---|---|
| CN | 110778109 | A | * | 2/2020 | E04G 11/48 |
| CN | 110778109 | A | | 2/2020 | |
| DE | 3125587 | A1 | * | 1/1983 | E04G 11/36 |
| DE | 102006055306 | A1 | * | 5/2008 | E04G 11/483 |
| DE | 102017210195 | A1 | * | 12/2018 | E04G 11/38 |
| EP | 945564 | A1 | * | 9/1999 | E04G 11/483 |
| ES | 2677695 | A1 | | 8/2018 | |
| GB | 905292 | A | * | 9/1962 | E04G 11/483 |
| GB | 2143272 | A | * | 2/1985 | E04G 11/483 |
| KR | 200423936 | Y1 | * | 8/2006 | E04G 2025/006 |
| KR | 101182142 | B1 | * | 12/2009 | E04G 2025/006 |
| KR | 20120096744 | A | * | 8/2012 | E04G 2025/006 |
| KR | 20130118515 | A | * | 10/2013 | E04G 11/486 |
| KR | 101421676 | B1 | * | 7/2014 | E04G 2025/006 |

OTHER PUBLICATIONS

Written Opinion of the International Searching Authority for related patent application PCT/ES2021/070035 prepared by the European Patent Office and uploaded to WIPO Patentscope Sep. 10, 2021, in English.

* cited by examiner

SECTION A-A

ANCHORING HEAD FOR FORMWORK STRUTS AND FORMWORK STRUT FOR PRODUCING SLOPED FLOORS

CROSS-REFERENCE TO RELATED APPLICATIONS

This application is a national stage under 35 U.S.C. § 371 of PCT patent application PCT/ES2021/070035 filed on 21 Jan. 2021, which is pending and which is hereby incorporated by reference in its entirety for all purposes. PCT/ES2021/070035 claims priority to European Patent Office Patent Application EP 20382161.6 filed on 6 Mar. 2020, which is hereby incorporated by reference in its entirety for all purposes.

DESCRIPTION

OBJECT OF THE INVENTION

The present invention refers to formwork systems including a series of beams supported on struts by means of a head, and more specifically, to said head.

More specifically, the present invention proposes the development of an anchoring head that enables said beams to be joined in inclined planes and at the same time adjusting and showing the inclination angle thereof, as well as a formwork strut for the implementation of inclined floors slabs provided with said head.

BACKGROUND OF THE INVENTION

In the construction sector, the use of struts provided with an anchoring head configured to support beams during a formwork phase of a construction is well known.

Document ES 2677695 is known which discloses a head for formwork struts comprising a support base that enables two beams to be placed adjacent to each other. However, this head does not enable one or both beams to be arranged in an inclined plane with respect to the horizontal plane of the ground and at the same time axially aligned in constructions, maintaining the verticality of the strut with respect to the horizontal plane of the ground, wherein the beams to be supported have to adopt an inclined position.

To solve this problem of alignment arrangement of two beams in a formwork strut, heads for formwork struts are known that enable two beams to be placed in alignment with each other. However, there is no system available to enable the operator to quickly shown the degree or angle of inclination that each of the beams must adopt in order to adjust the positioning means of the beams to be supported. For this, the operator uses an additional template or accessory to know the degree of inclination desired, so it requires more preparation time during the positioning of the anchoring struts.

Furthermore, the applicant is currently unaware of an invention that has all the features described in this specification.

DESCRIPTION OF THE INVENTION

The present invention has been developed with the aim of providing an anchoring head for formwork struts which is configured as a novelty within the field of application and which solves the aforementioned drawbacks, further contributing other additional advantages which will be obvious from the description below.

It is therefore an object of the present invention to provide an anchoring head for formwork struts, to support a pair of beams adjacent to each other, comprising a support, an erect region configured to be coupled to a strut, wherein there are two separate positioning shafts transversely arranged with respect to the erect region, and being adjustable in height by means of a height adjusting system, the positioning shafts being configured to support a respective beam in a firm way by means of releasable locking means.

Particularly, the support comprises visual indicating means to indicate the angular position of each one of the beams to be supported, the indicating means being associated with the positioning shaft of the beam to be supported by a cam arrangement, the cam arrangement being provided with a cam member coupled to the positioning shaft, such that the position of the cam is directly related to the height at which the positioning shaft is located.

Thanks to these features, a system is obtained that enables each one of the beams to be placed to be positioned on the head in a completely independent way from each other, by having two positioning means with their respective adjusting elements, and having a system that enables the height of the positioning means to be adjusted at the same time that the operator can easily visualise the degree of inclination adopted. Furthermore, another relevant aspect, is the fact that it enables the two beams to be arranged in alignment with each other at an angle of inclination with respect to the ground.

In accordance with another aspect of this invention, the cam arrangement comprises a cam member mounted at each end of the positioning shaft, the cam member being provided with a cam surface configured to come into contact with a static region located in the support.

Preferably, the visual indicating means may comprise a plurality of marks that make possible, for example, to indicate the percentage of the slope or the angle of the beam to be supported with respect to a horizontal plane, the marks being distributed along the periphery of the cam surface and a reference mark located in the support.

Advantageously, the height adjusting means may comprise a bolt provided with a pair of threaded portions located at opposite ends, the bolt having a region where the positioning shaft is coupled, and wherein the support includes mounting holes through which a respective positioning shaft can slide.

According to another aspect of the invention, the aforementioned locking means may consist of hexagonal clamping nuts that can be coupled to the threaded portions situated in the bolt.

Alternatively, the locking means may consist of clamping nuts with a knurled outer surface able to be coupled to the threaded portions present in the bolt. In this way, it is possible to make it easier for an operator to manipulate the assembly during the positioning of the positioning shaft at the desired height, without using additional tools.

In a particularly preferable embodiment, the locking means consist of a combination of hexagonal clamping nuts and clamping nuts with a knurled outer surface able to be coupled to the threaded portions present in the bolt.

According to another aspect of the invention, the erect region is provided with a tiltable support surface that is rotatably hinged in said erect region. In this way, it is possible for the top portion of the head to be in contact with an inclined plane when installed in a formwork strut, while maintaining the strut in a plane perpendicular to the horizontal plane (ground or resting surface).

According to another feature of the anchoring head of the invention, the support can have two casings spaced apart and joined together, by means of a central platen wherein the erect region is arranged, the height adjusting means and the locking means being mounted on each one of the casings.

Also preferably, the static region is defined by a pair of pins separated from each other, which are in contact with the surface of the cam member at any point in the height at which the positioning shafts are located.

Preferably, two static regions arranged on the same side of the support are offset in relation to each other in a horizontal plane, such that each one of the static regions is located at a different height. This facilitates the longitudinal alignment of two beams to be positioned when their longitudinal axis is inclined with respect to the horizontal plane.

Advantageously, the extension may include a fastening system comprising a region provided with a plurality of through holes configured for the insertion of screw elements and a plurality of projections protruding perpendicularly with respect to the longitudinal axis of the erect region. Preferably, the plurality of projections adopts a cross-shaped radial arrangement. This system makes possible the installation of diagonally arranged profiles in a formwork structure in a quick and simple way that does not require additional fastening elements, such as flanges or the like.

It is also another object of the invention to provide a formwork strut comprising an elongated (tubular) profile that includes an anchoring head in the top portion thereof as in the aforementioned one.

The anchoring head for struts described therefore represents an innovative structure with structural and constituent features heretofore unknown for its intended purpose, reasons which, taken together with its usefulness, provide it with sufficient grounds for obtaining the requested exclusivity privilege.

Other features and advantages of the anchoring head for struts object of the present invention will be evident in light of the description of a preferred, but not exclusive, embodiment which is illustrated by way of a non-limiting example in the drawings which are attached, wherein:

DESCRIPTION OF A PREFERRED EMBODIMENT

Figure 1:
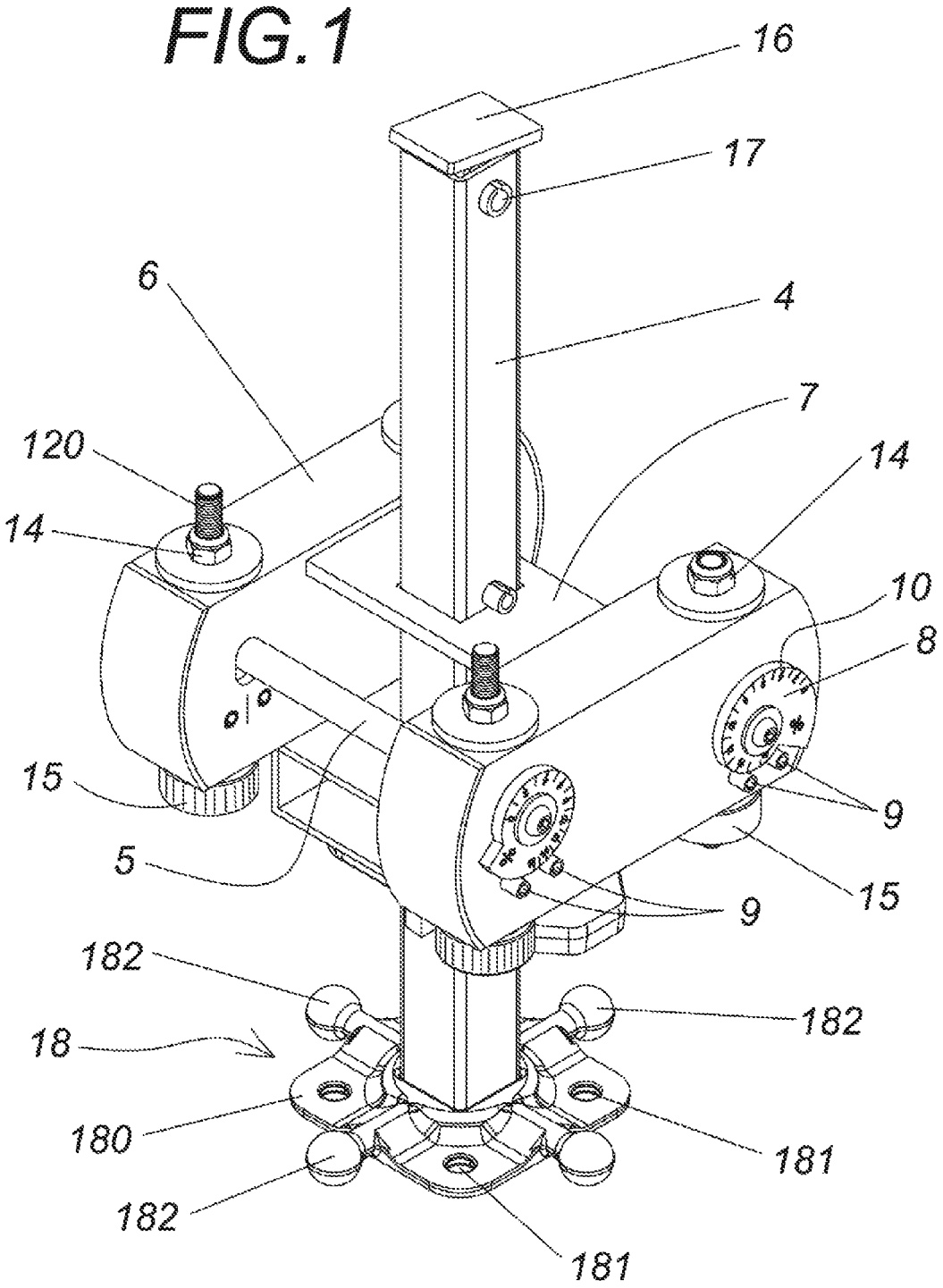
FIG. 1 is a perspective view of an embodiment of the anchoring head for struts for the implementation of inclined floor slabs, provided with said head in accordance with the present invention.

In light of the aforementioned figures, and in accordance with the adopted numbering, one may observe therein an example of a preferred embodiment of the invention, which comprises the parts and elements indicated and described in detail below.

In the embodiment, an anchoring head is shown, indicated generally with the reference (1), for installation on formwork struts (2), envisioned to support two adjacent beams (3) axially aligned with each other at an angle of inclination with respect to a horizontal plane, comprising a support, a region defined by an internally hollow elongated profile (4) configured to be coupled to a strut (2), which extends at the upper and lower ends with respect to the support.

The support comprises visual indicating means, described in greater detail below, which are configured to indicate the angular position of each one of the beams to be supported, the indicating means being associated with the positioning shaft (5) of the beam to be supported by a cam arrangement. This cam arrangement is provided with a cam member coupled to the positioning shaft (5), such that the position of the cam is directly related to the height at which the positioning shaft (5) is located.

The support has two casings (6) spaced apart and joined together by at least one central platen (7) wherein an elongated profile (4) is arranged, the height adjusting means and the locking means being mounted on each one of the casings (6). The casings (6) are made of any suitable material, such as metal.

It must be noted that relative terms with orientations, such as "upper", "lower", "above" and "below" should be considered in a condition of the anchoring head mounted on a strut vertically arranged with respect to a support surface or ground.

Going into greater detail regarding the cam arrangement, it comprises the cam member (8) mounted on each one of the ends of the positioning shaft (5), the cam member (8) (with an outer contour in the form of a "snail" such that it has a variable diameter) being provided with a cam surface configured to come into contact with a static region located in the support. As can be seen, this static region is defined by a pair of pins (9) separated from each other, which are in contact with the surface of the cam member at all times.

It should be mentioned that the two static regions arranged on the same side of the support (6) are offset a gap (d) (see FIG. 4) from each other with respect to a horizontal plane, such that each one of the static regions is located at a different height.

Now, with respect to the visual indicating means present in the cam arrangement, they comprise a plurality of marks (10) that indicate the slope of the beam (3) to be supported with respect to a horizontal plane, and a reference mark (11) situated in the support, more specifically between the two pins (9). As can be seen, these marks (10) are distributed along the periphery of the surface of the cam member (8) and indicate a percentage of inclination ranging from 0% to 16%.

Figure 2:
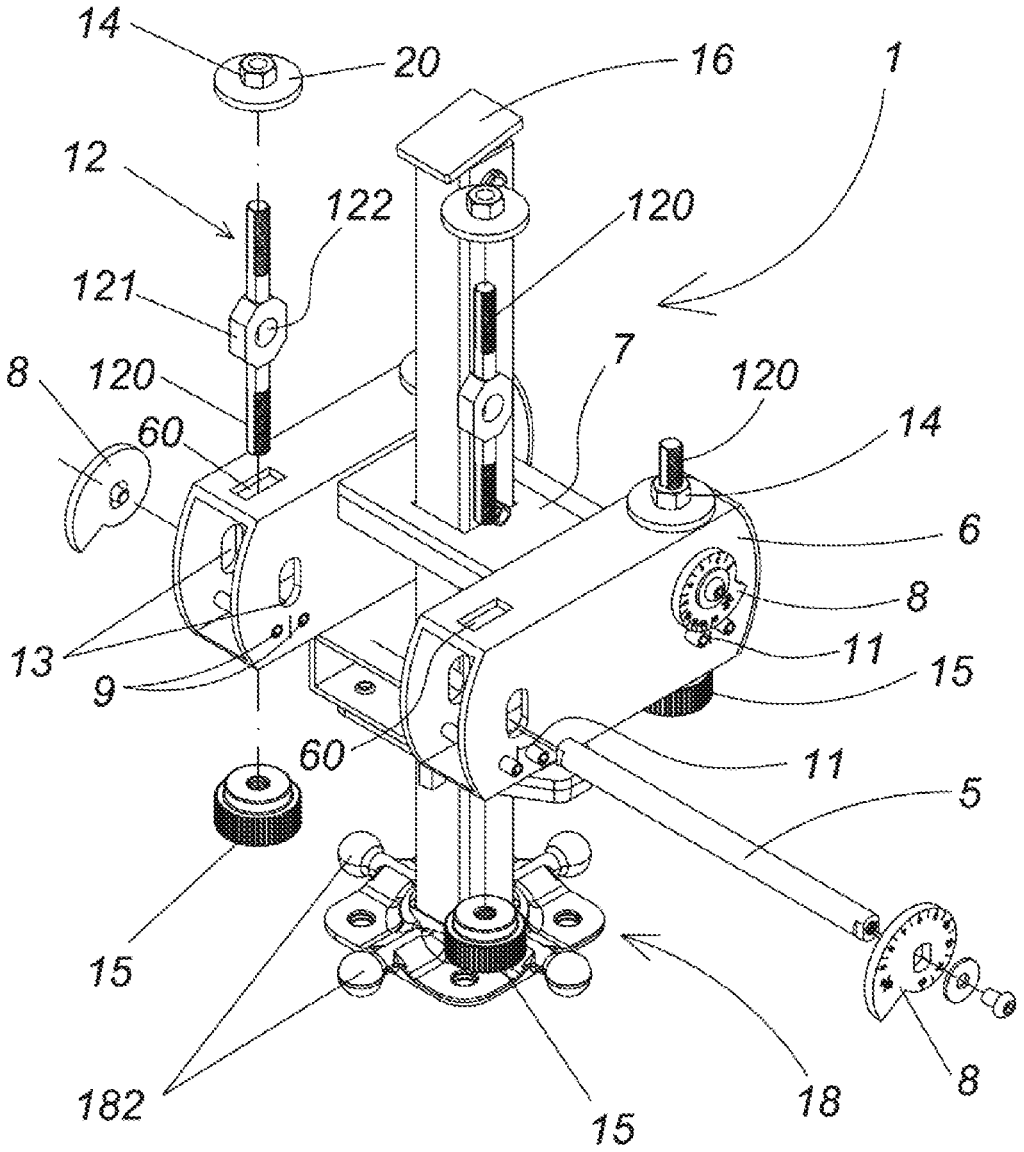
FIG. 2 is an exploded perspective view of the anchoring head according to the present invention in which some portions of the casings have been removed for reasons of clarity.
Figure 3:
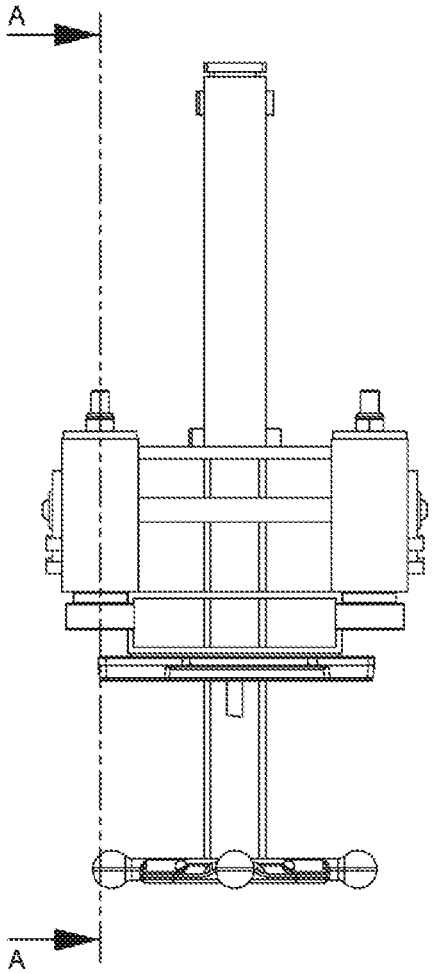
FIG. 3 is a side elevation view of the head depicted in FIG. 1.
Figure 4:
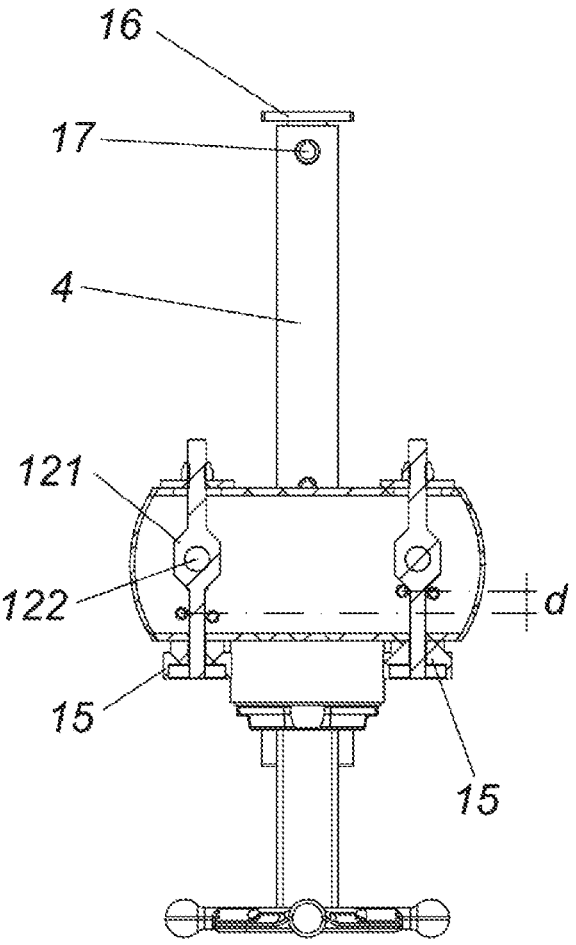
FIG. 4 is a cross-sectional view along the A-A line shown in FIG. 3.
Figure 5:
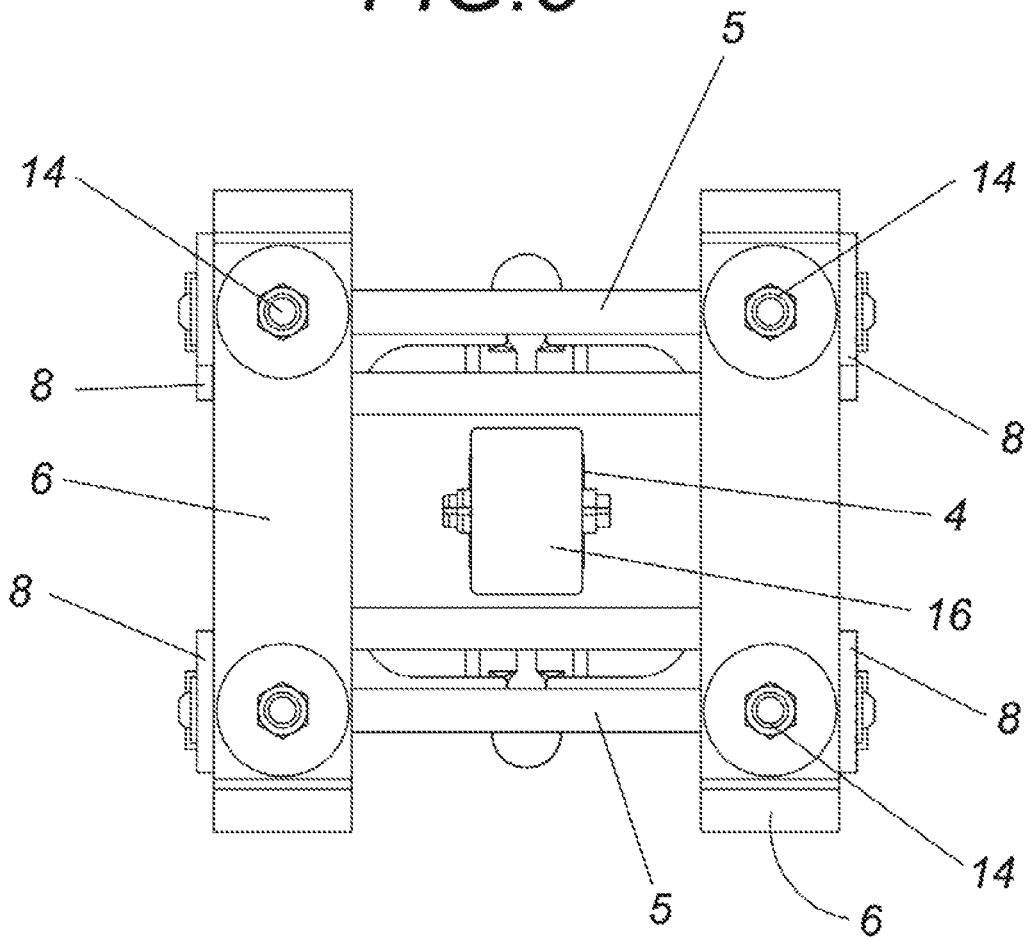
FIG. 5 is a plan view of the head depicted in FIG. 1.
Figure 6:
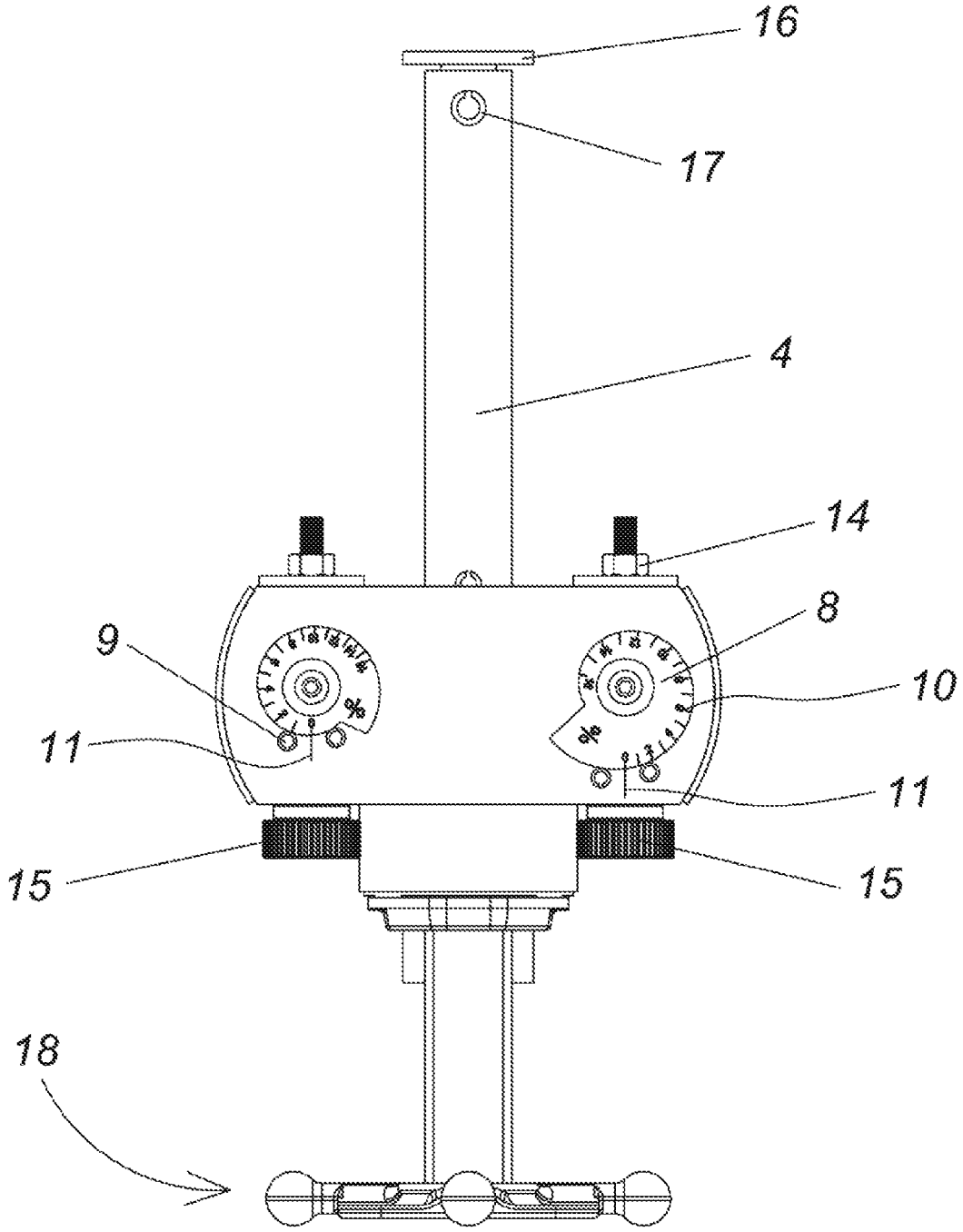
FIG. 6 is a front elevation view of the anchoring head configured to adopt a 0%-degree slope between two axially aligned beams.
Figure 7:
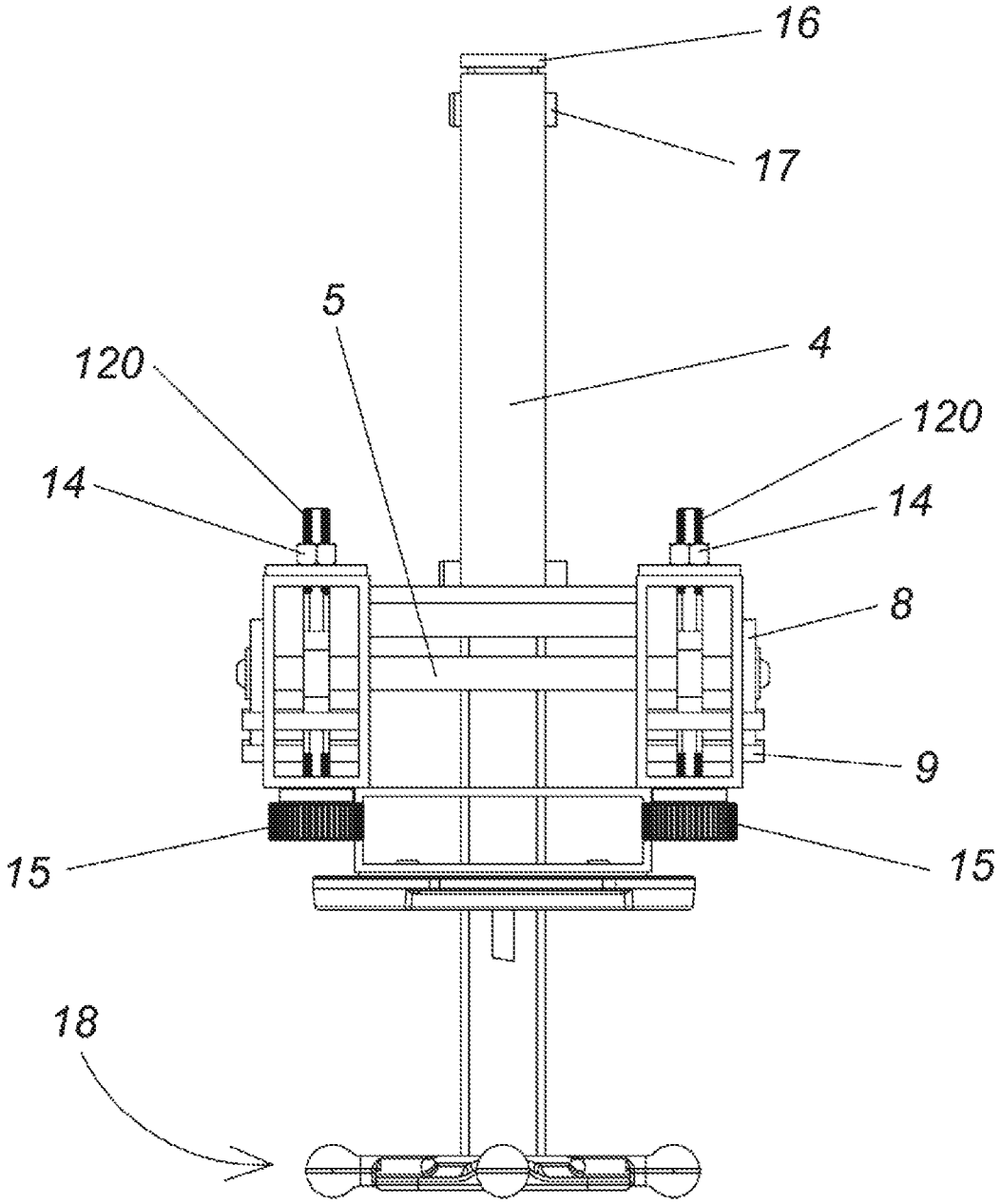
FIG. 7 is a side elevation view of the anchoring head configured to adopt a 0%-degree slope between two axially aligned beams, in which portions have been removed for reasons of clarity.

With respect to the height adjusting means, they comprise bolts (12) that are vertically arranged and pass through holes (60) made in the casings (6). These bolts (12) are each provided with a pair of threaded portions (120) located at the upper and lower ends. In FIGS. 2 and 4, it can be seen how the bolt has a central widened region (121) having a through hole (122) where the positioning shaft is coupled. Each one of the casings (6) that make up the support includes mounting holes (13) through which the positioning shaft (5) can slide to place it at the desired height. The length (or height) of the mounting holes (13) determines the total path that the positioning shaft (5) can cover to place the beams (3).

Referring now to the locking means, they consist of a combination of hexagonal clamping nuts (14) located in the top portion, that is to say, threaded in the threaded top portion (120) and clamping nuts with a knurled outer surface (15) coupled to the threaded portions (120) of the lower portion of the bolt (12). As can be seen more clearly in FIG. 2, the hexagonal clamping nuts (14) located on the top portion of each one of the casings (6) include a washer (20), such that it ensures the correct positioning of the nuts on the surface of the casing (6).

Additionally, to ensure a contact between the top portion of the formwork strut (2) and a formwork board (not depicted), the elongated profile (4) that forms part of the anchoring head (1) includes in the top portion thereof a tiltable support surface, which is made up of a platen (16) that is rotatably hinged by means of a rotation shaft (17) coupled to the top portion of said profile (4).

The profile (4) includes a fastening system at the lower portion thereof, indicated generally with the reference (18) comprising a region (180) with a substantially rectangular shape, which is provided with a plurality of through holes (181) configured for the insertion of screw elements (not shown) and a plurality of projections (182) with a substantially spherical shape that protrude perpendicularly with respect to the longitudinal axis of the elongated profile (4), which are provided for the arrangement of diagonally arranged bars or profiles that provide greater stabilisation. The plurality of projections (182) adopts a general cross-shaped radial arrangement and are configured to fit in grooves present in the diagonal profiles. In this specification, the coupling system between the fastening system (18) and the diagonal profiles will not be entered into greater detail as it is not the subject of the present invention.

Next, the operation of the anchoring head (1) described above is described once it is placed on a formwork strut (2).

First, an operator releases the positioning shafts (5) by unscrewing the nuts (14) and (15) that support the positioning shafts (5). It should be mentioned that the stresses exerted by the weight of the beams to be supported (3) are mainly supported by the hexagonal nuts (16) located in the top portion of the anchoring head (1). Next, the operator raises or lowers one or both positioning shafts, while performing a rotation thereof, in such a way that it matches the mark (10) that indicates the desired slope to obtain with the reference mark (11) present in the casing (6). Subsequently, once the operator has the desired height of the positioning shaft that corresponds to the slope, he first screws the lower nuts and then the upper nuts to block the movement of the positioning shaft (5) during use thereof.

Figure 8:
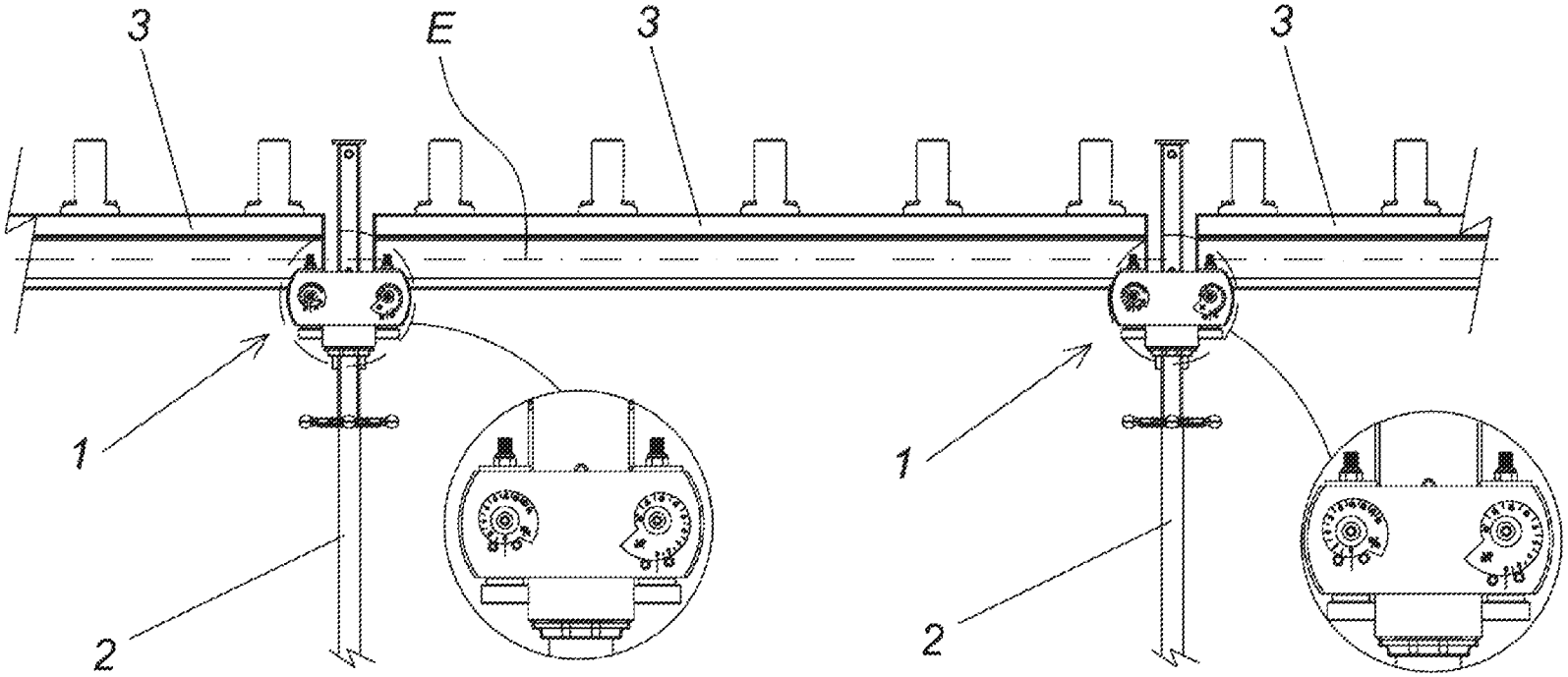
FIG. 8 is an elevation view showing the object of the invention in a first arrangement of beams.

FIG. 8 shows an arrangement of two anchoring heads (1) supporting three beams (3), which are axially aligned with each other and arranged in a horizontal plan situated e (see longitudinal axis (E)), so that the cam member in each one of the anchoring elements (1) is arranged such that the marking visually indicates a 0% slope (see the enlarged details relating to the cam member of each one of the anchoring heads).

Figure 9:
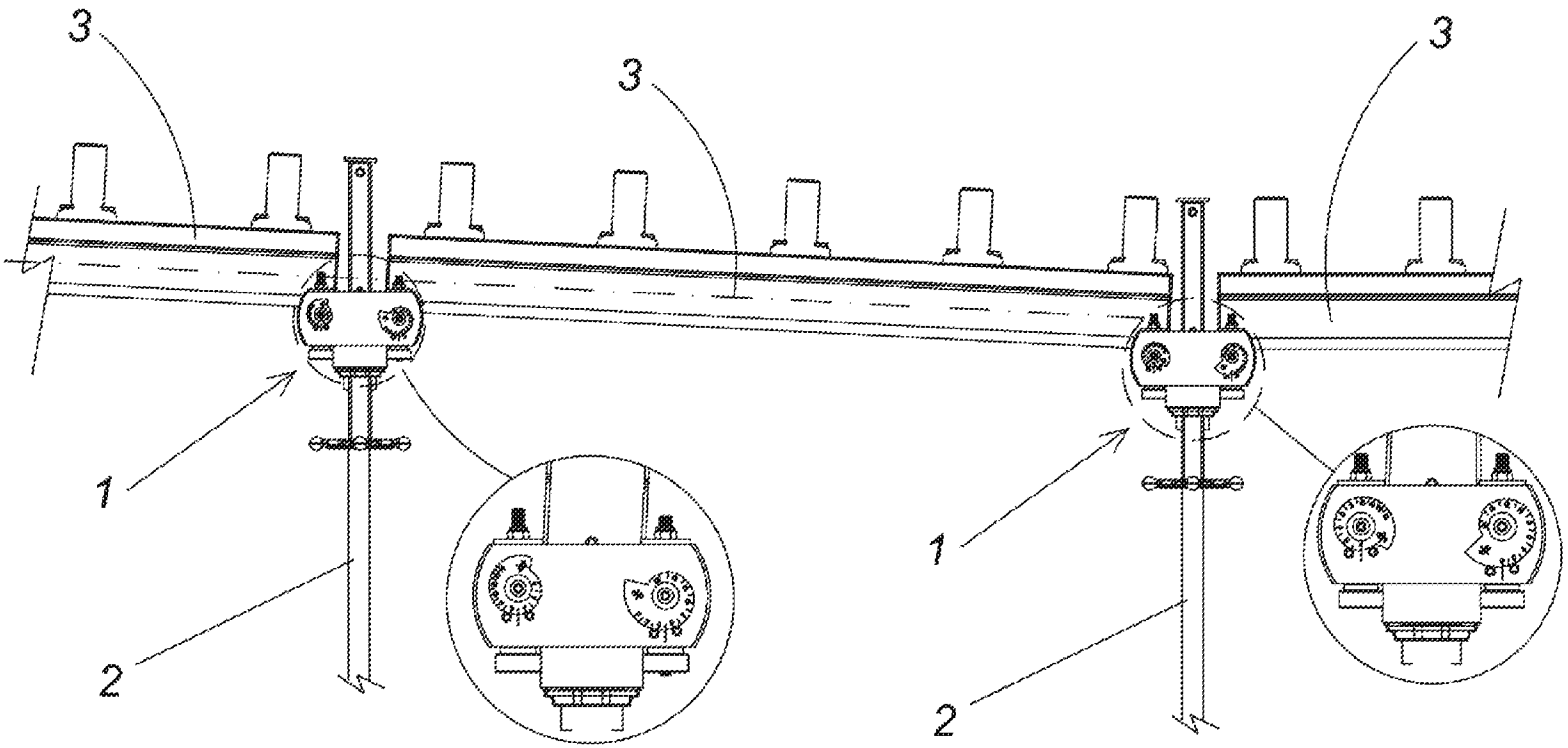
FIG. 9 is an elevation view showing the object of the invention in a second arrangement of beams.

It can be seen from FIG. 9 a second arrangement having two anchoring heads (1) supporting three beams (3), two of the beams being aligned with each other and inclined with respect to a third beam (located to the right of the drawing) which is arranged in a horizontal plane. In this case, the two beams (3) are inclined by 5 degrees with respect to the horizontal beam, as indicated in the cam members of the anchoring head (1) located to the left of the drawing (see the enlarged details relating to the cam member), that is, the mark (10) indicating 5% is aligned with the reference mark (11).

Figure 10:
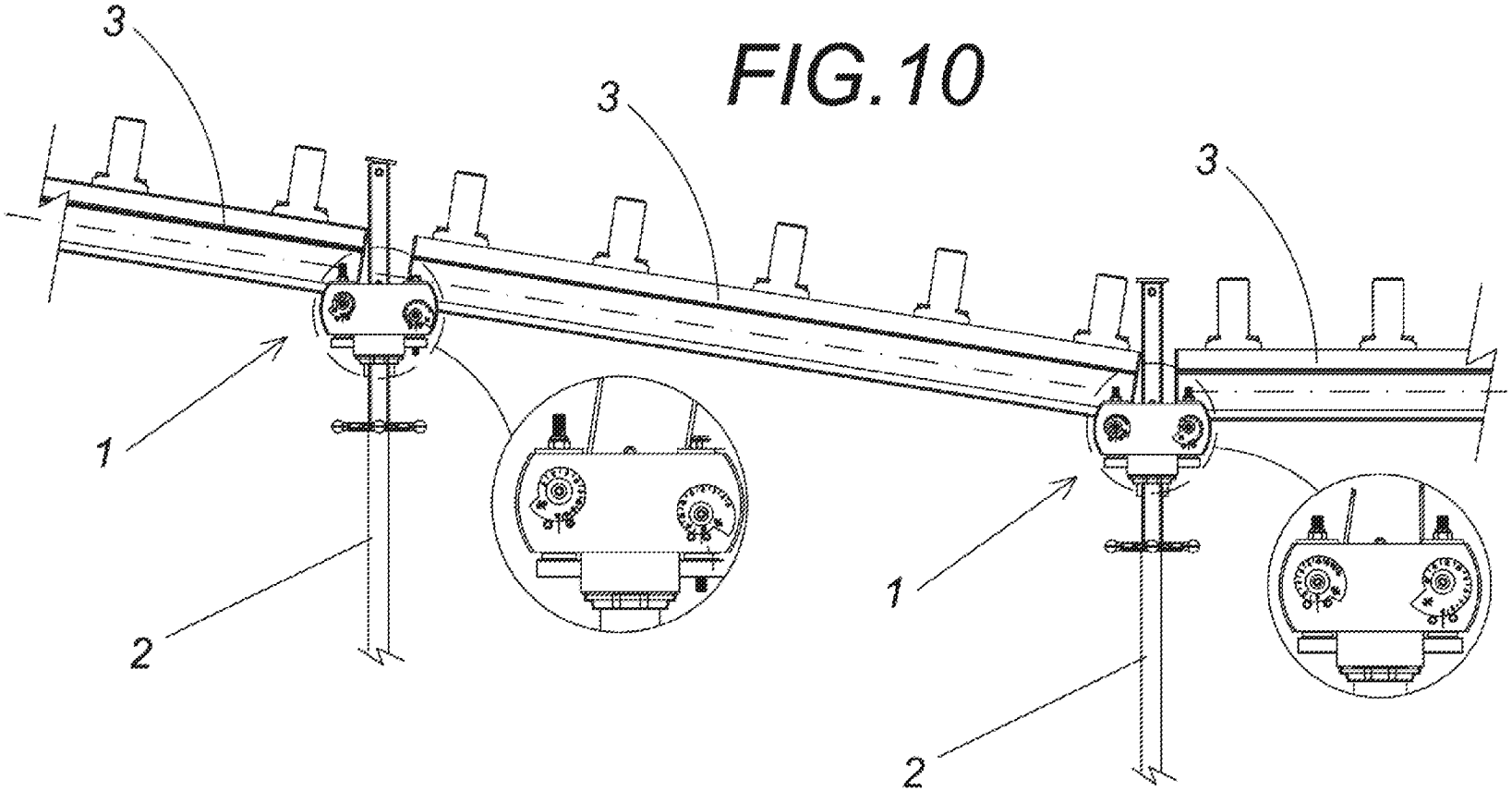
FIG. 10 is an elevation view showing the object of the invention in a third arrangement of beams.

FIG. 10 shows a third arrangement of two anchoring heads (1) supporting three beams (3), two of the beams being aligned with each other and inclined with respect to a third beam (located to the right of the drawing) which is arranged in a horizontal plane. In this case, the two beams are inclined by 16 degrees with respect to the horizontal beam, as indicated in the cam members of the anchoring head (1) located to the left of the drawing (see the enlarged details relating to the cam member), that is, the mark (10) indicating 16% is aligned with the reference mark (11).

The details, shapes, dimensions and other accessory elements, used to manufacture the anchoring head of the invention, may be suitably substituted for others which do not depart from the scope defined by the claims which are included below.

NUMERICAL REFERENCES

1. Anchoring head
2. Formwork strut
3. Beams
4. Profile
5. Positioning shaft
6. Casing
60. Hole
7. Central platen
8. Cam member
9. Pin
10. Marks
11. Reference mark
12. Bolt
120. Threaded portion
121. Central widened region
122. Through hole
13. Mounting hole
14. Hexagonal nut
15. Nut with knurled outer surface
16. Platen
17. Rotation axis
18. Fastening system
180. Region
181. Through hole
182. Projection

What is claimed is:

1. An anchoring head for a formwork strut to support a first beam adjacent to and axially aligned with a second beam, the anchoring head comprising:

a support assembly for supporting the first and second beam, an erect region for coupling to the formwork strut to be mounted, a first positioning shaft transversely arranged with respect to the erect region and being adjustable in height by a first height adjusting system, the first positioning shaft being configured to fixedly support the first beam by a first releasable lock;

a second positioning shaft transversely arranged with respect to the erect region and being adjustable in height by a second height adjusting system, the second positioning shaft being configured to fixedly support the second beam by a second releasable lock;

wherein the support assembly comprises a first visual indicator associated with the first positioning shaft to indicate a respective angular position of the first beam by a first cam arrangement, and a second visual indicator associated with the second positioning shaft to indicate a respective angular position of the second beam by a second cam arrangement; e wherein each cam arrangement is provided with a respective cam member coupled to the respective positioning shaft, so that the position of the cam member is directly related to a height at which the respective positioning shaft is located;

wherein each cam arrangement comprises a respective cam member mounted on each end of the respective positioning shaft, the respective cam member being provided with a respective cam surface configured to come into contact with a static region situated in the support assembly.

2. The anchoring head according to claim 1, wherein each visual indicator comprises a plurality of marks indicating the slope of the respective beam with respect to a horizontal plane, the marks being distributed along the periphery of the respective cam surface of the respective cam member and a reference mark is located in the support assembly.

3. The anchoring head according to claim 1, wherein each respective height adjusting system comprises a bolt provided with threaded portions, the bolt having a region where the respective positioning shaft is coupled, and wherein the support assembly includes mounting holes through which the respective positioning shaft is able to slide.

4. The anchoring head according to claim 3, wherein each releasable lock consists of hexagonal clamping nuts able to be coupled to the threaded portions present in the bolt.

5. The anchoring head according to claim 3, wherein each releasable lock consists of clamping nuts with a knurled outer surface able to be coupled to the threaded portions present in the bolt.

6. The anchoring head according to claim 3, wherein each releasable lock consists of a combination of hexagonal clamping nuts and clamping nuts with a knurled outer surface able to be coupled to the threaded portions present in the bolt.

7. The anchoring head according to claim 1, wherein the erect region is provided with a tiltable support surface that is rotatably hinged in the erect region.

8. The anchoring head according to claim 1, wherein the support assembly has two casings spaced apart and joined together by at least one central platen wherein the erect region is arranged, each height adjusting system and each releasable lock is mounted on one of the respective casings.

9. The anchoring head according to claim 1, wherein the static region is defined by a pair of pins separated from each other, which are in contact with the surface of the respective cam member.

10. The anchoring head according to claim 1, wherein two static regions arranged on the same side of the support assembly are offset from each other in a horizontal plane, such that each one of the static regions is located at a different height.

11. The anchoring head according to claim 1, wherein the erect region includes a fastening system comprising a region provided with a plurality of through holes configured for the insertion of screw elements and a plurality of projections protruding perpendicularly with respect to a longitudinal axis of the erect region.

12. The anchoring head according to claim 11, wherein the plurality of projections takes a cross-shaped radial arrangement.

13. A formwork strut for the implementation of inclined floor slabs comprising:

an elongated profile provided with an anchoring head coupled thereto;

the anchoring head for the formwork strut to support a first beam adjacent to and axially aligned with a second beam, the anchoring head comprising:

a support assembly for supporting the first and second beam, an erect region for coupling to the formwork strut to be mounted, a first positioning shaft transversely arranged with respect to the erect region and being adjustable in height by a first height adjusting system, the first positioning shaft being configured to fixedly support the first beam by a first releasable lock;

a second positioning shaft transversely arranged with respect to the erect region and being adjustable in height by a second height adjusting system, the second positioning shaft being configured to fixedly support the second beam by a second releasable lock;

wherein the support assembly comprises a first visual indicator associated with the first positioning shaft to indicate a respective angular position of the first beam by a first cam arrangement, and a second visual indicator associated with the second positioning shaft to indicate a respective angular position of the second beam by a second cam arrangement;

wherein each cam arrangement is provided with a respective cam member coupled to the respective positioning shaft, so that the position of the cam member is directly related to a height at which the respective positioning shaft is located;

wherein each cam arrangement comprises a respective cam member mounted on each end of the respective positioning shaft, the respective cam member being provided with a respective cam surface configured to come into contact with a static region situated in the support assembly.

14. The formwork strut according to claim 13, wherein each respective height adjusting system comprises a bolt provided with threaded portions, the bolt having a region where the respective positioning shaft is coupled, and wherein the support assembly includes mounting holes through which the respective positioning shaft is able to slide.

15. The formwork strut according to claim 14, wherein each releasable lock consists of hexagonal clamping nuts able to be coupled to the threaded portions present in the bolt.

16. The formwork strut according to claim 14, wherein each releasable lock consists of clamping nuts with a knurled outer surface able to be coupled to the threaded portions present in the bolt.

17. The formwork strut according to claim 14, wherein each releasable lock consists of a combination of hexagonal clamping nuts and clamping nuts with a knurled outer surface able to be coupled to the threaded portions present in the bolt.

* * * * *